US006766591B1

(12) United States Patent
McKinney et al.

(10) Patent No.: US 6,766,591 B1
(45) Date of Patent: Jul. 27, 2004

(54) GARMENT DRYING APPARATUS

(75) Inventors: Larry Todd McKinney, Weston, FL (US); Keith C. Bernard, Hollywood, FL (US); Joseph J. Laskowski, Derby, CT (US)

(73) Assignee: HP Intellectual Corp., Wilmington, DE (US)

( * ) Notice: Subject to any disclaimer, the term of this patent is extended or adjusted under 35 U.S.C. 154(b) by 0 days.

(21) Appl. No.: 10/431,183

(22) Filed: May 7, 2003

(51) Int. Cl.[7] ..... F26B 25/00

(52) U.S. Cl. ..... 34/104; 34/105; 34/106; 34/232; 34/234; 34/202; 34/239

(58) Field of Search ..... 34/90, 91, 104, 34/105, 106, 218, 220, 232, 233, 234, 201, 202, 103, 239, 437, 440, 442

(56) References Cited

U.S. PATENT DOCUMENTS

| | | | |
|---|---|---|---|
| 2,076,735 | A | 4/1937 | Leindorf |
| 2,443,695 | A | 6/1948 | Russell |
| 2,465,362 | A | 3/1949 | Elliott |
| 2,614,337 | A | 10/1952 | Darbo |
| 3,154,392 | A | 10/1964 | Littman |
| 3,203,112 | A | 8/1965 | Edmonds |
| 3,299,529 | A | 1/1967 | Roberts et al. |
| 3,417,482 | A | 12/1968 | Peet |
| 3,513,564 | A | 5/1970 | Gramprie |
| 3,645,009 | A | 2/1972 | Ketchum |
| 3,793,744 | A | 2/1974 | Saita |
| 4,085,519 | A | 4/1978 | Masika |
| 4,136,464 | A | 1/1979 | Hay |
| 4,145,602 | A | 3/1979 | Lee |
| 4,171,580 | A | 10/1979 | Vabrinskas |
| 4,198,765 | A | 4/1980 | Miyamae |
| 4,200,993 | A | 5/1980 | Blanc et al. |
| 4,265,030 | A | 5/1981 | Smallegan |
| 4,727,656 | A | 3/1988 | Jannach et al. |
| 4,768,293 | A | 9/1988 | Kaffka |
| 4,787,153 | A | 11/1988 | Chen |
| 4,908,957 | A | 3/1990 | Acosta, Sr. et al. |
| D310,742 | S | 9/1990 | Johnson |
| 4,967,060 | A | 10/1990 | Lomeli |
| 4,981,651 | A | 1/1991 | Horng |

(List continued on next page.)

FOREIGN PATENT DOCUMENTS

JP 01022237 A * 1/1989 ..... A47L/23/20

OTHER PUBLICATIONS

Chengdu Rainbow Appliance (Group) Sharers Co., Ltd. An Advertisement for a Rainbow Shoes Dryer.

*Primary Examiner*—Jiping Lu
(74) *Attorney, Agent, or Firm*—Barry E. Deutsch

(57) ABSTRACT

A garment drying apparatus includes a housing forming a base. A heater is mounted in the base for warming ambient air drawn into the base via a fan through openings formed in the base. A pair of air ducting walls are mounted in the base to direct a portion of the warm air in a first flow path and the remaining portion of the warm air in a second flow path. The flow paths are disposed in substantially diametrically opposed directions within the base. The housing further includes a top wall for covering the base. The top wall includes vent openings aligned with distal ends of the first and second flow paths. Garment support members are mounted on the top surface of the top wall and are pivotable between a first position where support is aligned substantially horizontally in a stowed position on the top wall and a second position where the support is substantially upright relative to the top wall. Each of the supports include vent openings alignable with the vent openings in the top wall when the supports are in their upright positions. Each of the supports have a wall alignable with the vent openings in the top wall when the supports are in the stowed position to close air flow through the top wall vent openings.

10 Claims, 7 Drawing Sheets

U.S. PATENT DOCUMENTS

| | | | |
|---|---|---|---|
| 5,003,707 | A | 4/1991 | Chu |
| 5,058,289 | A | 10/1991 | Guindon |
| 5,179,790 | A | 1/1993 | Poulos |
| 5,199,188 | A | 4/1993 | Franz |
| 5,222,308 | A | 6/1993 | Barker et al. |
| 5,287,636 | A | 2/1994 | Lafleur et al. |
| 5,379,525 | A | 1/1995 | Raynor |
| 5,412,928 | A | 5/1995 | Reithel |
| 5,570,515 | A | 11/1996 | Schulte |
| 5,592,750 | A | 1/1997 | Eichten |
| 5,692,316 | A | 12/1997 | Antal |
| 5,720,108 | A | 2/1998 | Rice |
| 5,729,908 | A | 3/1998 | Braden |
| 5,894,680 | A | 4/1999 | Dalvy et al. |
| 6,085,436 | A | 7/2000 | Peet |

* cited by examiner

GARMENT DRYING APPARATUS

BACKGROUND OF THE INVENTION

This invention relates to a hot air dryer suitable for use in drying garments such as mittens, shoes, boots, and the like, an in particular to such an apparatus that is capable of simultaneously drying two pairs of garments such as shoes and boots with a uniform air flow and through the use of interchangeable garment supports.

The utilization of hot air dryers to dry garments such as shoes, boots, gloves, mittens, and the like is a well-known technology. Many of the prior art garment drying apparatus are designed to accommodate only one type of garment, for example, shoes, or mittens, or boots. Likewise, many of the prior garment drying apparatus could only accommodate drying one pair of garments at any one time. Even those dryers that were designed to accommodate the drying of more than one pair of garments at one time were not designed to provide a uniform air flow to each of the pairs of garments.

Accordingly, it is an object of the present invention to provide a garment drying apparatus which can accommodate simultaneous drying of more than one pair of garments while providing a substantially uniform air flow to each of the pairs of garments being dried.

SUMMARY OF THE INVENTION

The foregoing object and other objects of the present invention are attained in a garment drying apparatus comprising a housing forming a base. Openings are provided in the base and a fan is mounted in the base for drawing air through the openings. A heater is mounted in the base for warming the air drawn through the openings by the fan. Air ducting walls mounted in the base direct a portion of the warm air in a first flow path and the remaining portion of the warm air in a second flow path. The first and second flow paths are disposed in substantially diametrically opposed directions within the base. The housing further includes a top wall for covering the base. The top wall includes vent openings aligned with distal ends of each of the first and second flow paths. At least two garment supports are mounted on the top surface of the top wall and are pivotable between a first position where a support is aligned substantially horizontally in a stowed position on the top wall and a second position where the support is substantially upright relative to the top wall. Each of the supports include vent openings alignable with the vent openings in the top wall when the supports are in the upright positions. Further, each of the supports includes a wall alignable with the vent openings in the top wall when the supports are in the stowed position to close air flow through the top wall vent openings. Each of the supports include discharge openings for the warm air.

The object of the invention is further attained in a garment drying apparatus including a housing forming a base; openings are formed in the base; and a fan is mounted in the base for drawing air through the openings. A heater is mounted in the base for warming the air drawn through the openings by the fan. A wall covers the base and includes vent openings for the warm air produced in the base. At least one garment support comprising a rigid structure is mounted on the top surface of the wall and is moveable to a first position where the support is substantially upright relative to the wall. The support includes vent openings alignable with the vent openings in the wall when the support is in the upright position. The garment support is selectively removable from the top wall for replacement by a second support comprising a flexible tube.

DESCRIPTION OF THE PREFERRED EMBODIMENTS

Figure 1:
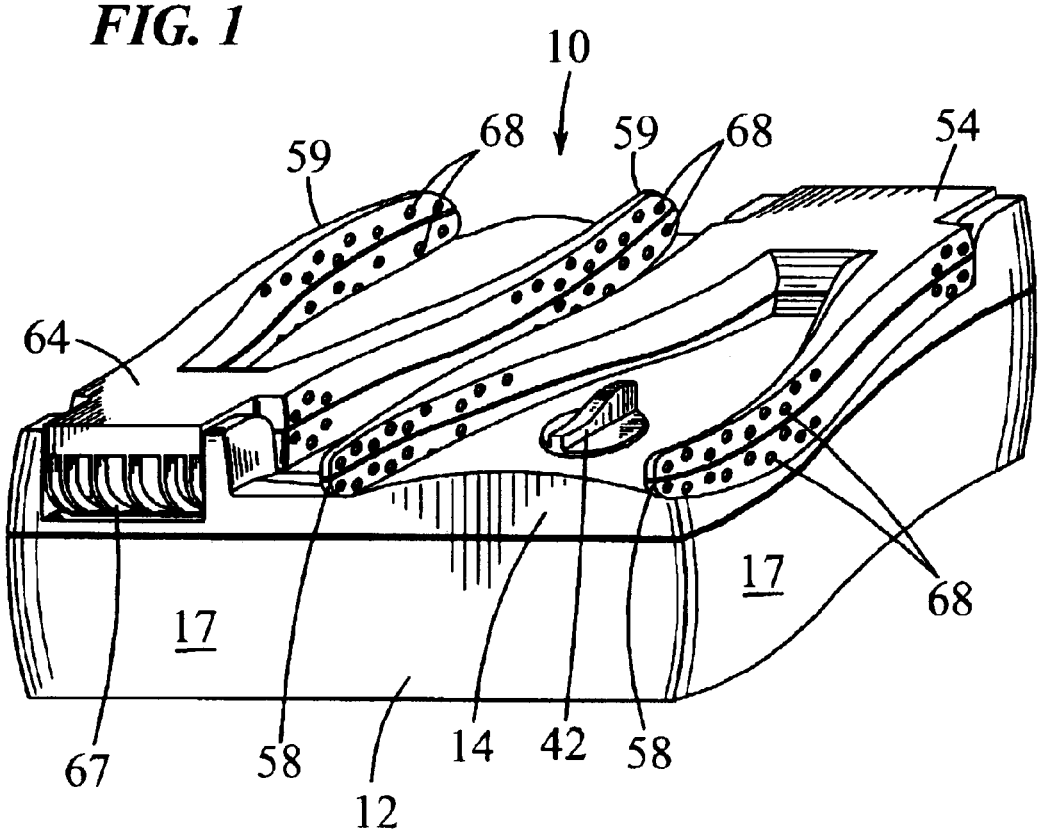
FIG. 1 is a perspective view taken from the top, front and right side of a garment drying apparatus in accordance with the present invention.

Referring now to the drawings, preferred embodiments of the present invention shall be described in detail. In referring to the various figures of the drawings, like numerals shall refer to like parts.

Referring specifically to FIGS. 1 through 6, there is illustrated a first embodiment of the invention. As indicated previously, the present invention relates to a garment drying apparatus 10. The garment drying apparatus includes a lower housing portion or base 12 and an upper housing portion or top wall 14 for covering the base. Base 12 includes a lower wall 15 and upstanding side walls 17 forming a generally rectangular structure. An opening 40 having a grill 41 disposed therein is formed in lower wall 15 to enable ambient air to be drawn into the base.

A motor 30 is mounted in the base and is connected to fan 32 for driving the fan when the motor is energized. The motor can be connected to a source of electrical energy such as alternating current or direct current. In the preferred embodiment, the motor is connected to a source of alternating current. A heater 34 circumferentially surrounds fan 32.

Walls 38, 44 form diametrically opposed air ducts for air discharged from fan 32 over heater 34. A timer module assembly 42 is electrically connected to motor 30 to control the operation of the motor as is well known to one skilled in the art. Two pairs of spaced bearings 36 are mounted at the distal ends 46, 48 of each air duct for a reason to be more fully described hereinafter.

Figure 2:
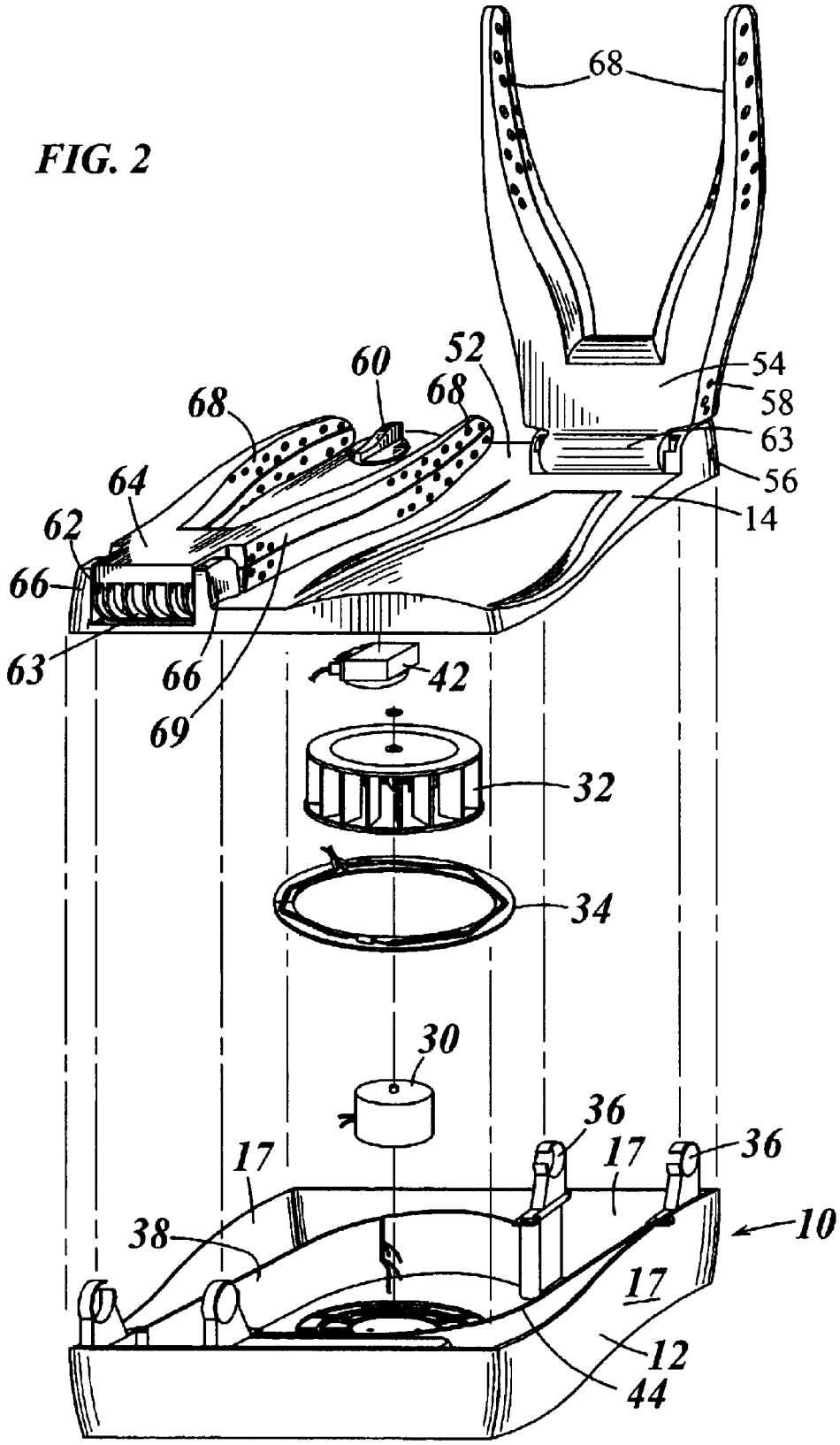
FIG. 2 is an exploded perspective view of the garment drying apparatus illustrated in FIG. 1, showing components of the apparatus.
Figure 3:
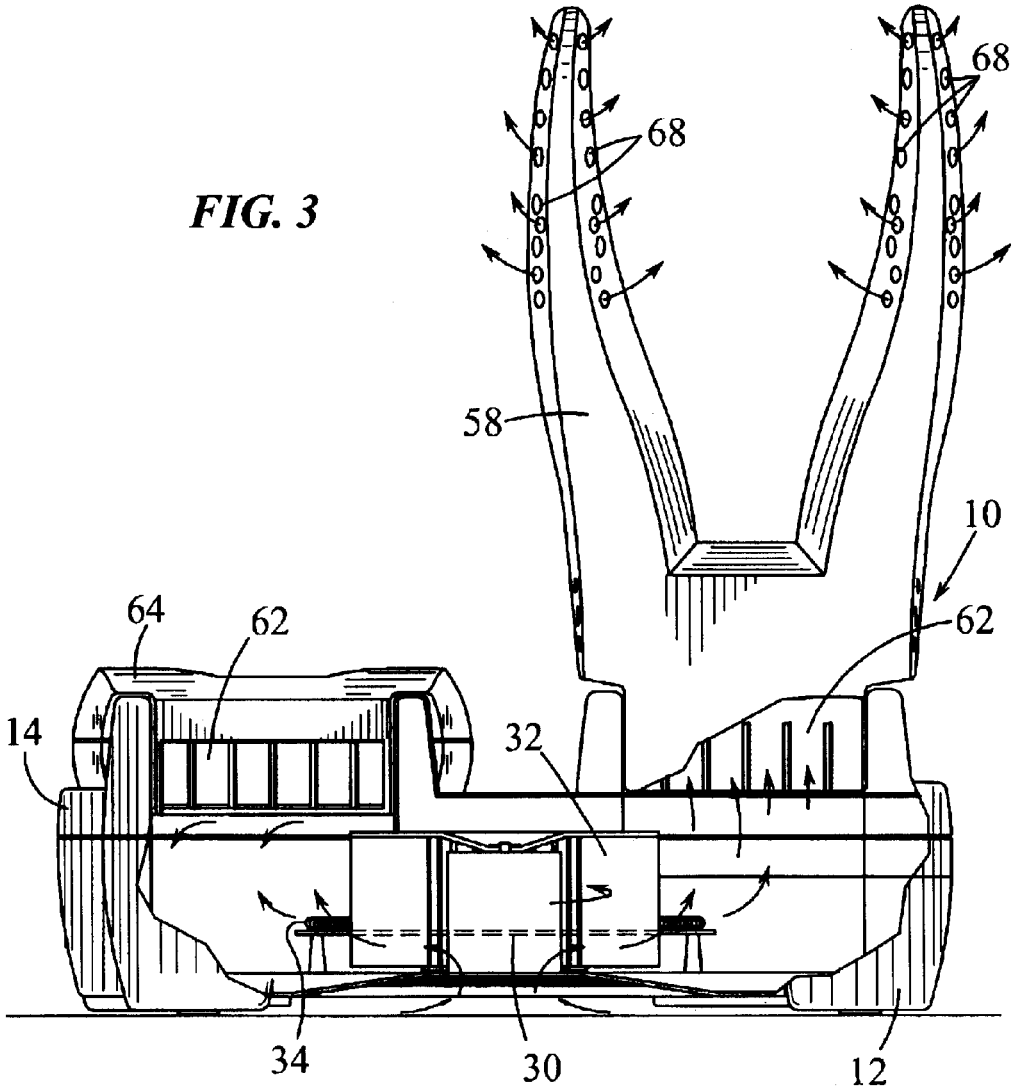
FIG. 3 is an elevation view of the embodiment of the invention illustrated in FIGS. 1 and 2, with portions broken away to illustrate details of the apparatus.
Figure 4:
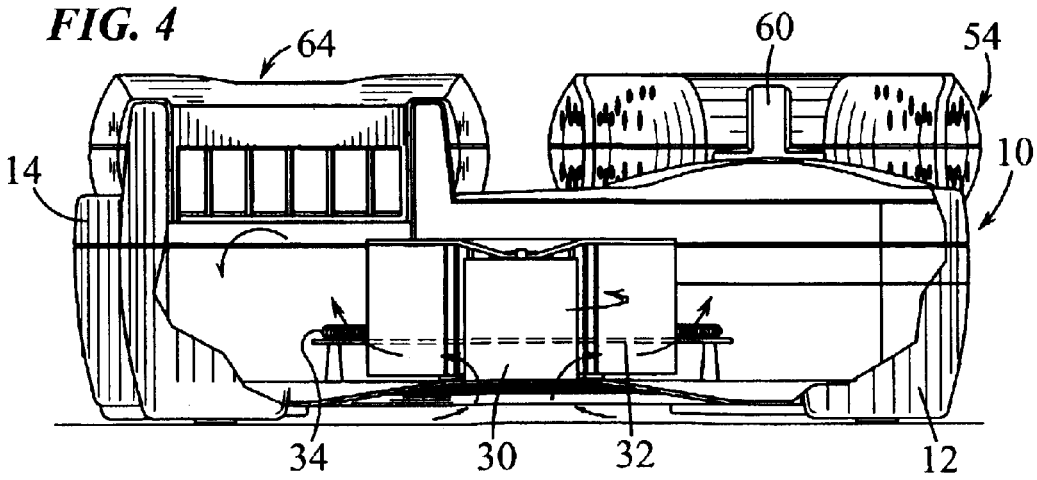
FIG. 4 is a view similar to that shown in FIG. 3 with the previously upright garment support in a lowered position.
Figure 5:
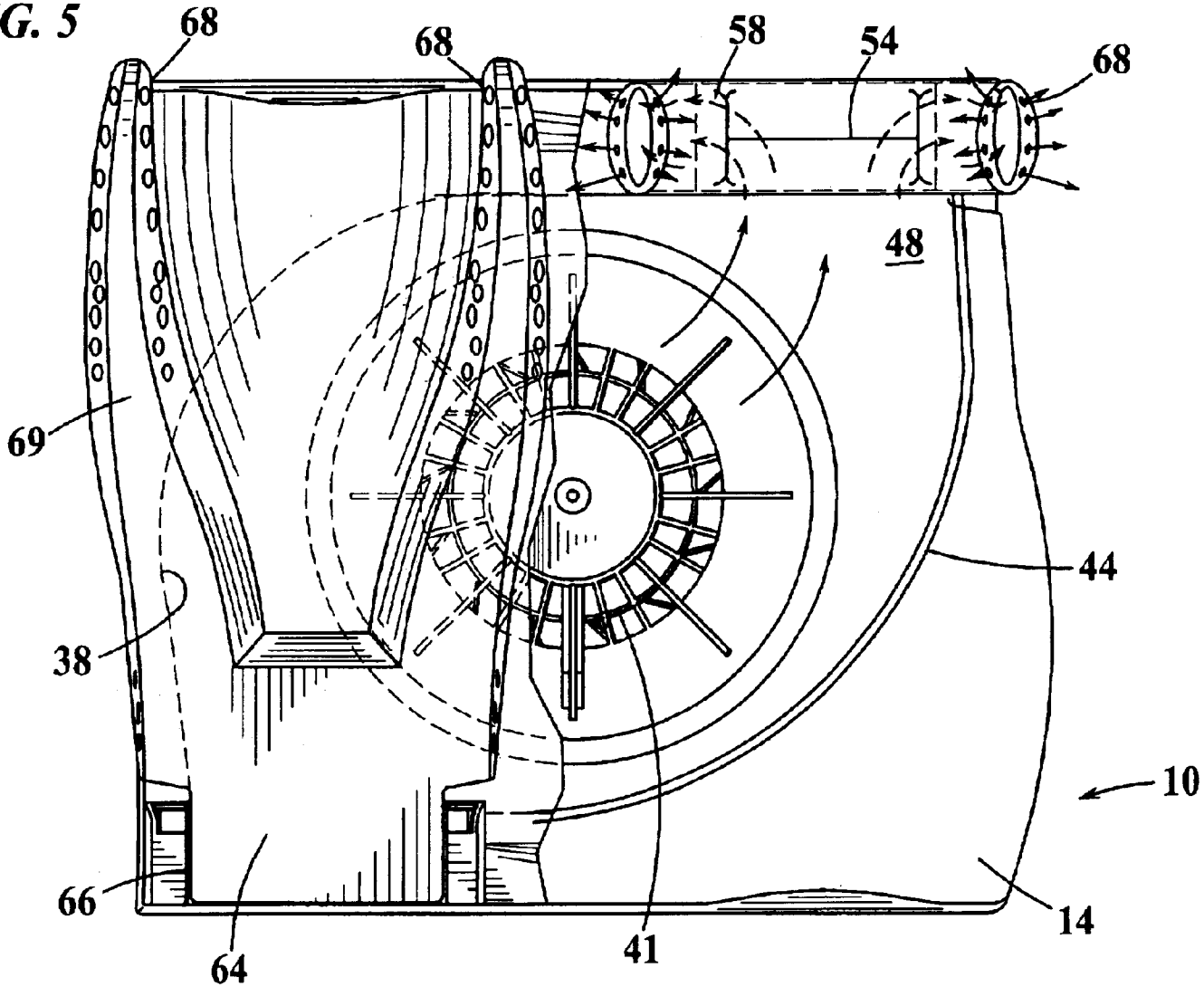
FIG. 5 is a top plan view of the embodiment of the invention as illustrated in FIGS. 2 and 3, with portions broken away to illustrate further details of the apparatus.
Figure 6:
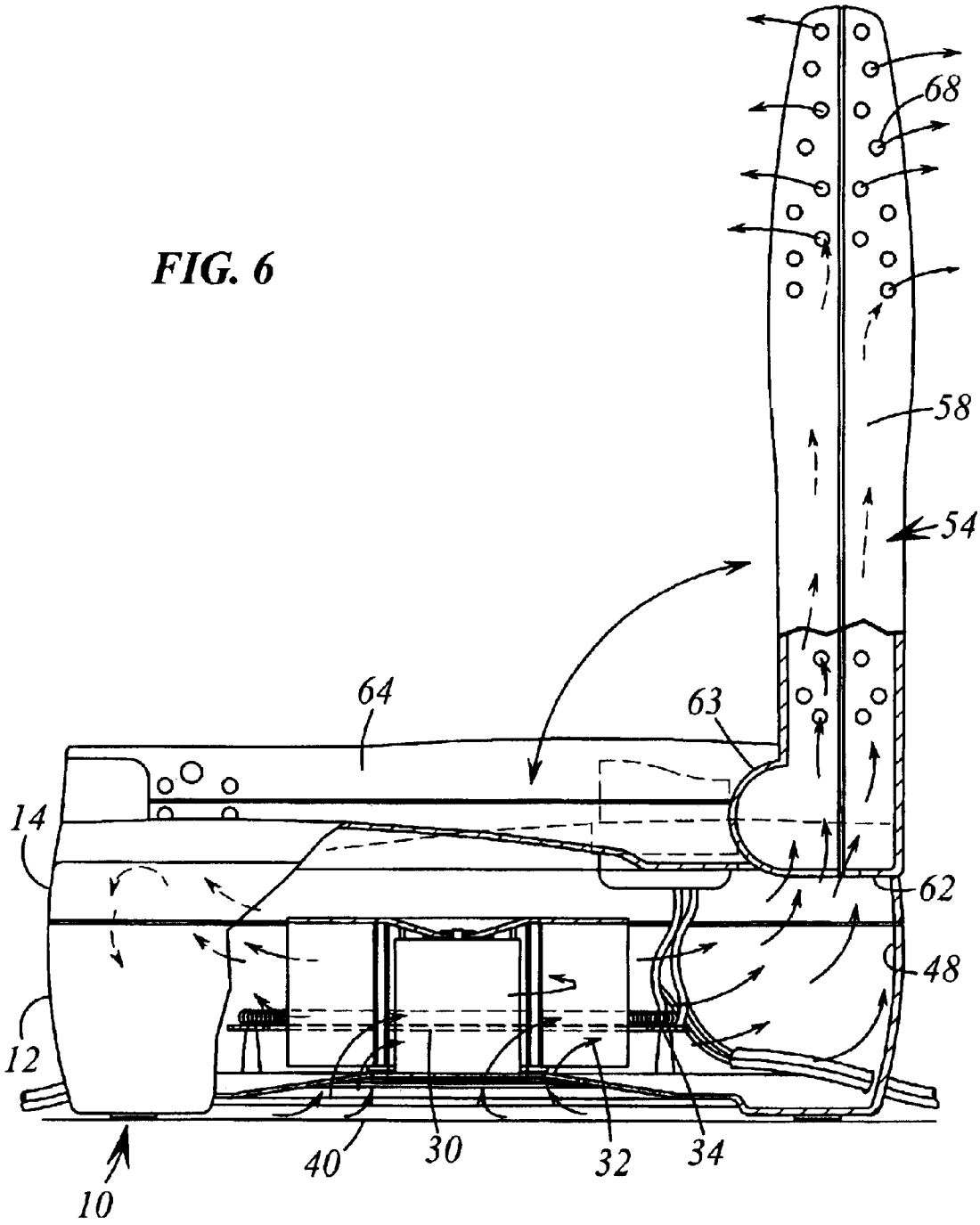
FIG. 6 is a side elevation view of the embodiment of the invention as illustrated in FIGS. 2 and 3, with portions broken away to further illustrate details of the invention.

Top wall or upper housing portion 14 is mounted upon base 12 so as to close the open area formed between side walls 17. Top wall 14 includes a pair of openings 67 (only one of which is shown in FIGS. 1 and 2) which are aligned with distal ends 46, 48 of the air ducts formed by walls 38 and 44 in lower housing 12. Bearings 36 extend upwardly through the openings and are supported within upstanding pedestals 56, 66. A pair of garment supports 54, 64 are pivotably mounted within bearings 36 on the top surface 52 of top wall 14. As illustrated, garment supports 54, 64 are pivotable between a first or stowed position where the support lies flat on the top surface 52 (see garment support 64 in FIG. 2) and an upright or second position where the garment support extends vertically upwardly from the top surface 52 (see garment support 54 in FIG. 2). Each of the garment supports includes a plurality of vent openings 68. Garment support 54 includes legs 58 and garment support 64 includes legs 69. Vent openings 68 are formed in the distal ends of legs 58, 69. A timer control knob 60 is mounted on top surface 52 and is connected to timer control assembly 42 so that the user of the garment dryer may pre-select a desired period of time or cycle during which the dryer will operate.

Each of the garment supports 54, 64 include a wall 63 and vent openings 62. When the garment support is in its stowed position, wall 63 is vertically aligned with openings 67 formed in top wall 14 to essentially shut off flow of air through the vent openings. When the garment support is in its vertically upright position, openings 62 are vertically aligned with openings 67 to enable air to flow through vent openings 67 into vent openings 62.

Each of the legs 58, 69 are hollow so that the air flowing into openings 62 passes inwardly into the garment support when the garment support is in an upright position. The air is discharged from the hollow legs through vent openings 68. Garment supports 54, 64 may be used to dry garments such as gloves, mittens, shoes, and the like which are draped over openings 68.

In operation, when motor 32 is energized, fan 32 draws ambient air through grill 41 of opening 40 and discharges the air over heater 34 to raise the temperature of the air above ambient temperature. The warmed air is discharged into the two air flow paths formed by the two diametrically opposed air ducts defined by walls 38, 44.

The user, prior to actuating motor 30, will place the garment or garments to be dried over the leg or legs of either or both garment support members 54, 64. To place the garment over the legs of the garment support, the user will raise the garment support into its upright position relative to top wall 14. In FIG. 2, garment support member 54 is intended to be used to dry a pair of garments whereas garment support member 64 remains in its stowed position.

In the stowed position, wall 63 of garment support member 64 will be vertically aligned with openings 67 to prevent air flow from distal end 46 into garment support member 64. All of the air discharged from fan 32 will be directed to distal end 48 where vents 67 of garment support 54 will be aligned with discharge openings 62. The air discharged through vents 67 will enter legs 58 of garment support member 54 and be discharged through vent openings 68 into the garment supported on each leg.

If both garment support members 54, 64 are placed in their upright position to dry two pairs of garments simultaneously, the air flow will be uniform to distal ends 46, 48 to provide substantially the same flow of air into each garment support. Essentially, the garment support members 54, 64 are placed in parallel with the air distribution flow from fan 32.

Figure 7:
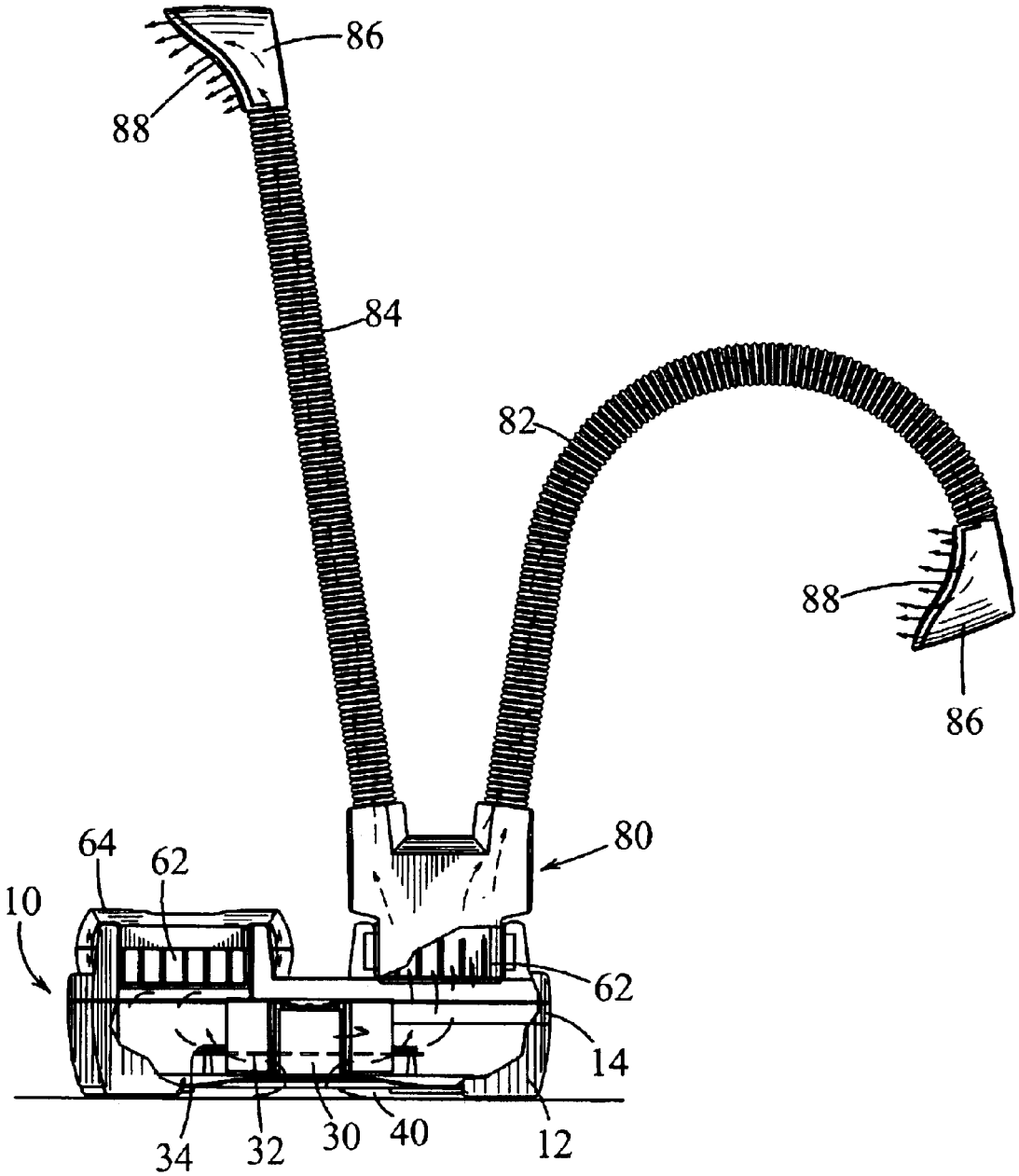
FIG. 7 is a front elevation view with portions broken away and similar to that shown in FIG. 3, with the exception that the upright garment support illustrated in FIG. 3 has been replaced by a second embodiment of a garment support.
Figure 8:
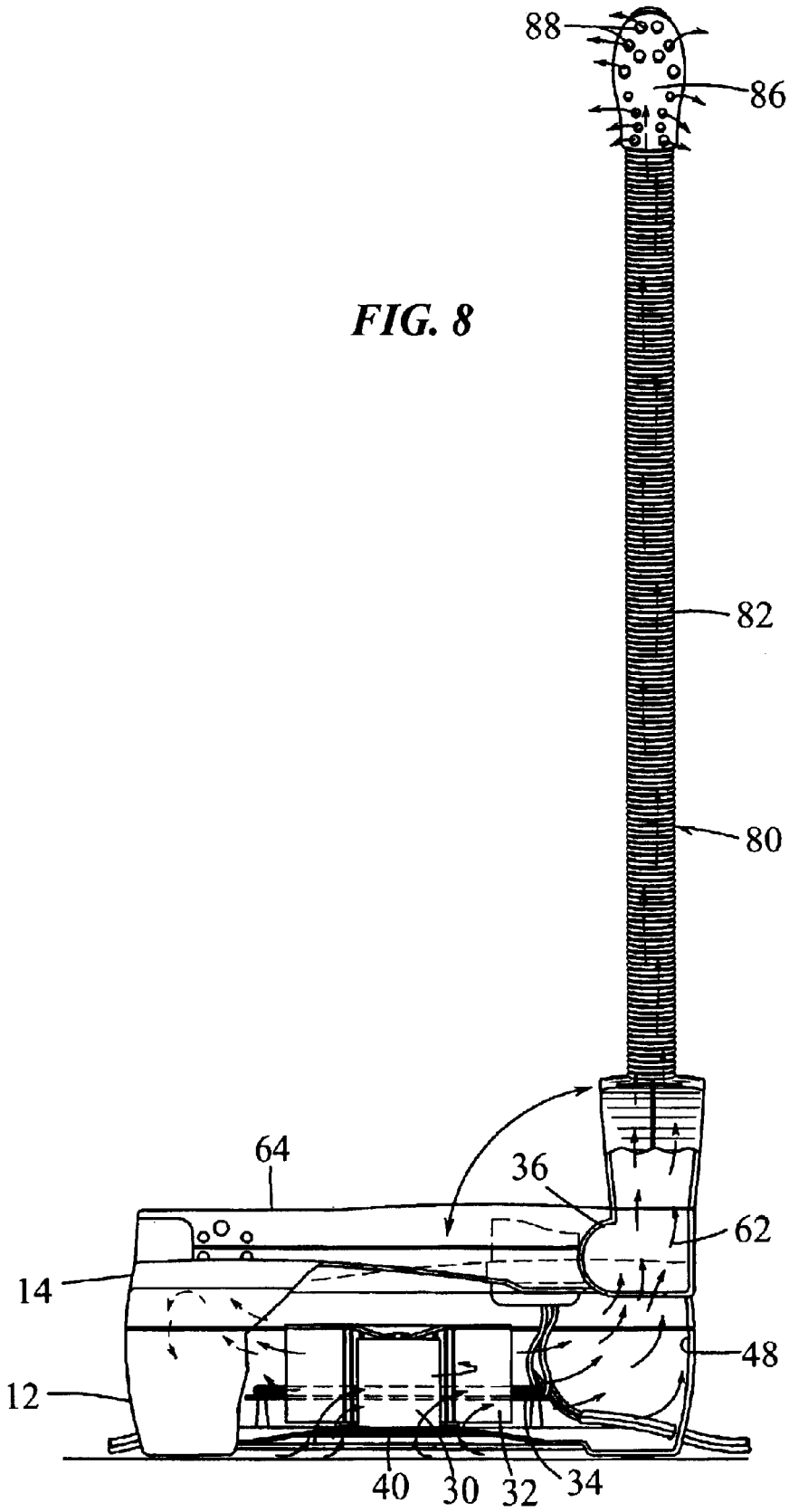
FIG. 8 is a side elevation view with portions broken away, further illustrating the second embodiment of the garment support shown in FIG. 7.

FIGS. 7 and 8 illustrate an alternative garment-drying member which may be used with garment dryer 10. If it is desired to dry boots or similar objects, one of the garment supports is removed, for example, support 54 and replaced by a different support 80 comprising a pair of elongated, hollow flexible tubes 82, 84, each of which terminates in a head 86 having a plurality of openings 88. The warm air for drying is discharged through openings 88 into the garment being dried. Garment support 80 includes vent openings 62 and wall 63 similar to those found in garment supports 54, 64. When the vent openings are aligned with vent openings 67 in top wall 14, air discharged from fan 32 flows into each of the flexible tubes 82, 84 and thence into a garment via openings 88.

While preferred embodiments of the present invention have been described and illustrated, the invention should not be limited thereto but may be otherwise embodied within the scope of the following claims.

What is claimed is:

1. A garment drying apparatus comprising:

a housing forming a base;

means forming openings in the base;

a fan mounted in the base for drawing air through said openings;

a heater mounted in the base for warming the air drawn through the openings by the fan;

air ducting walls mounted in the base for directing a portion of the warm air in a first flow path and the remaining portion of the warm air in a second flow path, said first and second flow paths being disposed in substantially diametrically opposed directions within said base;

said housing further including a top wall for covering said base, said top wall including vent openings aligned with distal ends of each of the first and second flow paths; and at least two garment supports mounted on the top surface of said top wall and pivotal between a first position where a support is aligned substantially horizontally in a stowed position on said top wall and a second position where the support is substantially upright relative to the top wall, each of said supports including vent openings alignable with the vent openings in said top wall when the supports are in the upright positions and each of said supports including a wall alignable with said vent openings in the top wall when the supports are in the stowed position to close air flow through said top wall vent openings, each of said supports including discharge openings for said warm air.

2. A garment drying apparatus in accordance with claim 1 further including a timer for controlling the period of operation of said apparatus.

3. A garment drying apparatus in accordance with claim 2 wherein at least one of said supports comprises a flexible tube.

4. A garment drying apparatus in accordance with claim 1 wherein at least one of said supports comprises a flexible tube.

5. A garment drying apparatus comprising:

a housing forming a base;

means forming openings in the base;

a fan mounted in the base for drawing air through said openings;

a heater mounted in the base for warming the air drawn through the openings by the fan;

a wall for covering said base, said wall including vent openings for the warm air produced in the base; and at least one garment support comprising a rigid structure mounted on the top surface of the wall and movable to a first position where the support is substantially upright relative to the wall, said support including vent openings alignable with the vent openings in said wall when the support is in the upright position, said garment support being selectively removable from said top wall for replacement by a second support comprising a flexible tube.

6. A garment drying apparatus in accordance with claim 5 further including a timer for controlling the period of operation of said apparatus.

7. A garment drying apparatus in accordance with claim 6 wherein a pair of rigid supports are mounted on the wall and one of said rigid supports is selectively removed for replacement by the flexible tube support.

8. A garment drying apparatus in accordance with claim 5 wherein a pair of rigid supports are mounted on the wall and one of said rigid supports is selectively removed for replacement by the flexible tube support.

9. A garment drying apparatus comprising:

a housing forming a base;

means forming openings in the base;

a fan mounted in the base for drawing air through said openings;

a heater mounted in the base for warming the air drawn through the openings by the fan;

air ducting walls mounted in the base for directing a portion of the warm air in a first flow path and the remaining portion of the warm air in a second flow path, said first and second flow paths being in substantially diametrically opposed directions within said base;

said housing including a top wall for covering said base, said top wall including vent openings aligned with the distal ends of each of the first and second flow paths; and at least two garment supports mounted on the top surface of said top wall and pivotable between a first position where a support is aligned substantially horizontally in a stowed position on said top wall and a second position where a support is substantially upright relative to the top wall, each of said supports including vent openings alignable with the vent openings in said top wall when the supports are in the upright positions and each of said supports including a wall alignable with said vent openings in the top wall when the supports are in the stowed position to close air flow through said top wall vent openings, each of said supports including discharge openings for said warm air, at least one of the rigid garment supports being selectively removable from said top wall for replacement by a second support comprising a flexible tube.

10. A garment dryer in accordance with claim 9 wherein a timer controls the period of operation of the drying apparatus.

* * * * *